US006105855A

United States Patent [19]

Kackstetter et al.

[11] Patent Number: 6,105,855

[45] Date of Patent: Aug. 22, 2000

[54] SELF LOCKING PAPERBOARD LID

[75] Inventors: Max K. Kackstetter, Alexandria; David J. Olds, Kilbourne, both of Ohio

[73] Assignee: Willamette Industries, Portland, Oreg.

[21] Appl. No.: 09/477,035

[22] Filed: Dec. 31, 1999

[51] Int. Cl.[7] ..... B65D 5/68

[52] U.S. Cl. ..... 229/125.26; 229/117.07; 229/125.29

[58] Field of Search ..... 229/117.07, 125.26, 229/125.27, 125.29, 174

[56] References Cited

U.S. PATENT DOCUMENTS

| | | | |
|---|---|---|---|
| 2,711,282 | 6/1955 | D'Esposito | 229/125.29 |
| 2,745,589 | 5/1956 | Daly et al. | 229/125.26 |
| 2,990,098 | 6/1961 | Kramer | 229/117.07 |
| 3,512,699 | 5/1970 | Wilson | 229/125.29 |
| 4,053,100 | 10/1977 | Baptist | 229/125.26 |
| 4,305,355 | 12/1981 | Sykora | 229/125.26 |
| 5,148,973 | 9/1992 | Zimmermann | 229/125.26 |

*Primary Examiner*—Gary E. Elkins
*Attorney, Agent, or Firm*—Francis T. Kremblas, Jr.

[57] ABSTRACT

A releasable locking lid formed from a planar blank of paperboard material which is adapted to fit a locking style box and which can be formed using automated paperboard folding equipment. Fold lines are provided in selected locations in the paperboard blank to define a top wall and two pair of opposing side walls surrounding the top wall. Each of one pair of side walls are configured to form a double ply in the final form and include a pair of cut-out portions which form recesses on the inner side of the double ply side wall which mate with corresponding flaps provided on the box to releasably lock the lid on the box. The double ply side walls also include a flap portion on each end adapted to mate with a diagonally folded flap on the ends of the other pair of opposing side walls. These flaps are adhesively bound together to connect the side walls to one another. The double ply side walls are also adhesively bound in the double ply configuration during the machine folding process to form a finished end product.

3 Claims, 6 Drawing Sheets

SELF LOCKING PAPERBOARD LID

CROSS-REFERENCE TO RELATED APPLICATIONS (Not applicable)

STATEMENT REGARDING FEDERALLY SPONSORED RESEARCH OR DEVELOPMENT (Not applicable)

MICROFICHE APPENDIX (Not applicable)

TECHNICAL FIELD

The present invention relates generally to paperboard boxes and lids and particularly to an improved lid construction for such boxes which forms a locking relationship upon mounting the lid over the open top of the box.

BACKGROUND OF RELATED ART

Among the many different types of paperboard box and closure lid combinations, it is desirable in a variety of applications to have a box and lid combination which cooperate to releasably lock together. One form of such locking lid construction which is particularly popular in the industry is one in which the closure lid includes a pair of inner recesses on one pair of opposing side walls which are adapted to engage a respective flap extending over the outer rim of the box.

One of the problems associated with this particular lid construction is that the paperboard blank must be manually folded and erected in its operative condition. In some cases folding and complete erection of the lid is accomplished by shipping the planar blank to the customer. Upon receipt, the customer must manually fold and set up the blank into its usable lid form to place over the top opening of the box.

The required labor to erect such releasably lockable lids from such a planar blank represents an added labor expense and an inconvenience which has remained a problem unsolved by those skilled in the art for many years.

BRIEF SUMMARY OF THE DISCLOSURE

The present invention relates generally to an improved paperboard closure lid provided with a locking feature which cooperates with a conventional box adapted to receive such a lid. The term lock as used herein is meant to refer to releasably securing the closure lid over the top opening of the box to avoid inadvertent removal of the lid from the box as is well-known to those skilled in the this art.

The improved lid construction of the present invention comprises a paperboard blank provided with fold lines and a configuration which facilitate folding and erecting the planar blank by machine manipulation which also applies an adhesive to secure the various portions of the lid so formed in an erected, usable condition.

The planar blank forming the lid includes fold or score lines which define a top wall surrounded by two opposing pairs of side walls. Upon hinging these fold is lines, the side walls extend away from the top wall at approximately a right angle. One pair of opposing side walls are provided with an extended length which is divided by a fold line which permits folding the respective side wall over itself to form a double ply configuration. The wall portion including an outer free edge of this extended length forms the inner ply and is provided with spaced, cut out portions which form part of the lock or securing means which cooperates with flaps on the box to secure the lid over the top opening of the box. The ends of the inwardly facing portion of the double ply sidewall also include an outwardly extending flap which folds inwardly over a fold line to overlie a portion of the adjacent side wall in the final erected condition.

The novel and improved configuration of the blank is not only readily machine foldable, but also permits automatically applying an adhesive to the fix the inner ply to the outer ply of the double ply side walls and to the extended flap portion and adjacent side wall to fix the two pair of opposing side walls together in an erected lid condition.

In a preferred embodiment, a diagonal score line is provided in each corner of the erected lid which permits the side walls and end walls to be folded inwardly into a relatively flat condition for shipping or storing purposes.

Therefore it is one aspect of the present invention to provide a locking type paperboard lid construction which is readily machine erectable including adhesively fixing the side walls to one another in the erected condition.

It is another aspect of the present invention to provide an improved lid construction of the type described which provides significant savings in manufacturing costs, labor and improved convenience to the ultimate customer.

DETAILED DESCRIPTION OF THE INVENTION

FIGS. 1–6 illustrate a lid closure constructed in accordance to the present invention which cooperates with a conventional paperboard box to form a releasably locked lid and box combination.

Figure 1:
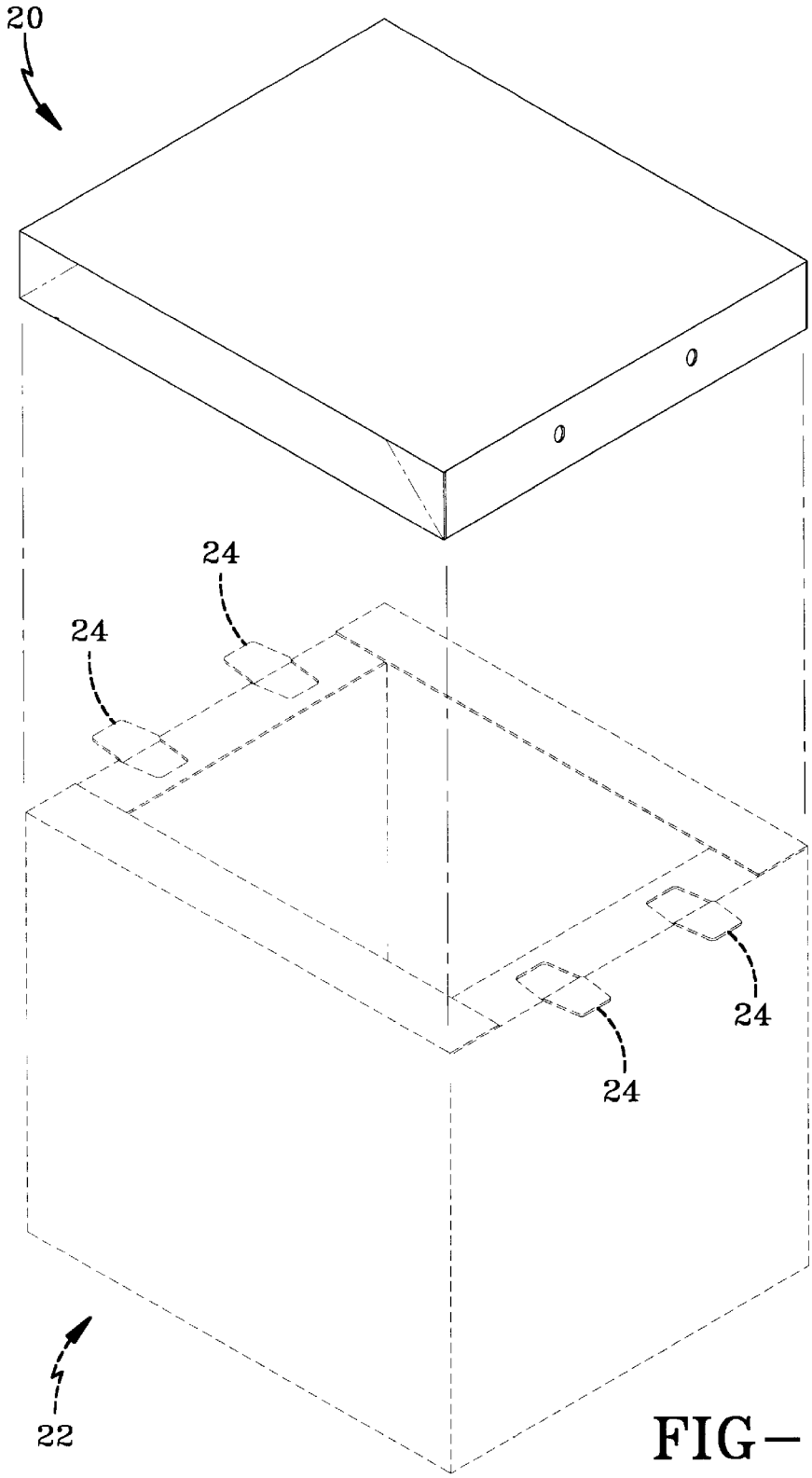
FIG. 1 is a perspective exploded view of an erected closure lid constructed in accordance with the present invention and a conventional box for receiving said lid in a releasably lock relationship.

As seen in FIG. 1, a paperboard lid closure, indicated generally at 20, constructed in accordance with the present invention is configured to be received over the top opening of a conventional paperboard box, indicated generally at 22, which is provided with a pair of foldable flaps 24 on opposing side portions. Upon sliding the erected lid 20 over the top opening of the box 22, flaps 24 are forced downwardly along the outer sides of box 22 to engagingly mate with recesses provided within lid 20 to releasably lock the lid to the box as described in detail later herein.

Figure 2:
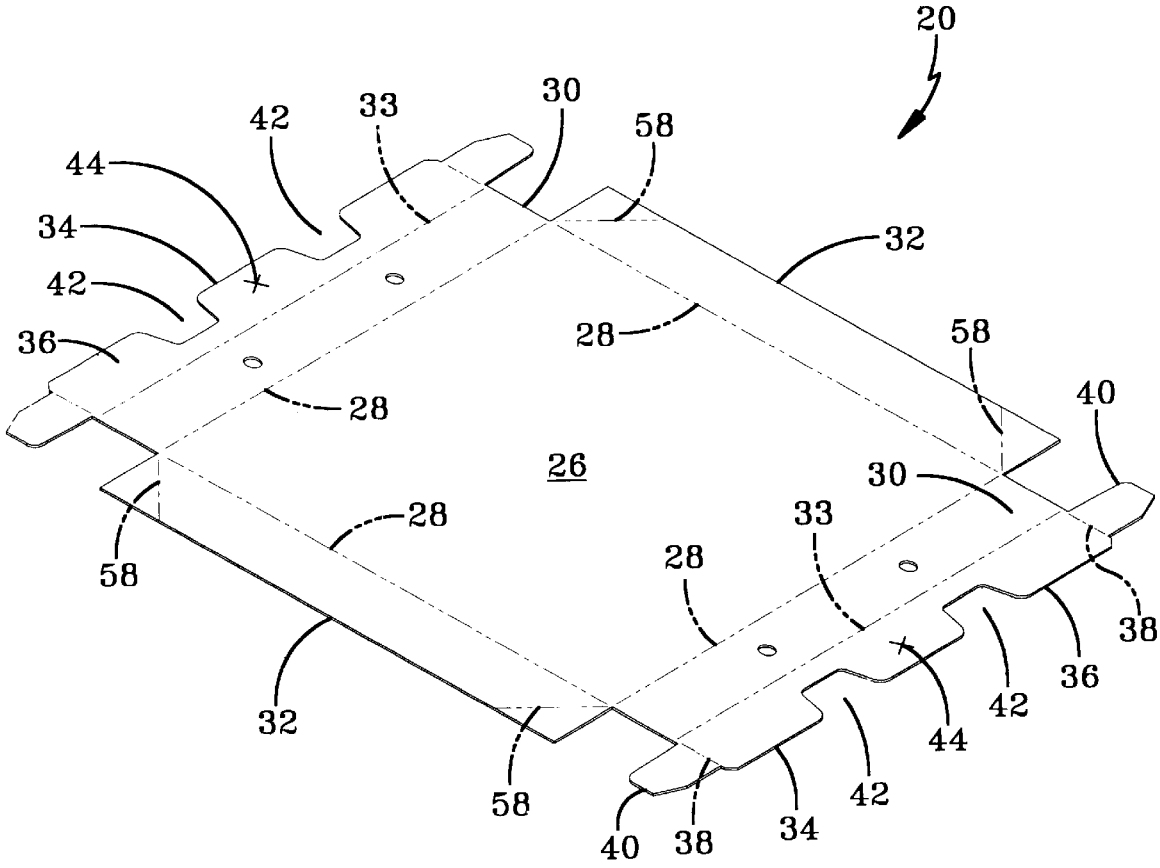
FIG. 2 is a perspective view of a planar blank from which the closure lid shown in FIG. 1 may be formed.

Lid 20 is formed from a paperboard blank, such as shown in FIG. 2, which includes a generally rectangular top wall 26 defined by opposing pairs of score or fold lines 28. A first and second pair of opposing side walls 30 and 32 extend upwardly when folded about score lines 28 to surround top wall 26.

Each one of the first pair of opposing side walls 30 is provided with a fold line 33 which is disposed generally parallel to one of fold lines 28 and intermediate an outer free edge 34 to form a side wall portion 36 between fold line 33 and an outer free edge 34. A pair of end flaps 40 extending from each end of side wall portion 36 are defined by a respective fold line 38 which is generally perpendicular to and intersects the end of a respective one of fold lines 32. A pair of cut-out portions 42 are provided in each side portion 36 for purposes explained in detail below.

The particular configuration and location of the above-described fold lines and portions of the paperboard blank forming lid 20 complement the readily machine erectable characteristic of lid 20. The ability to use automated folding machine to erect the lid 20 represents a significant saving of labor cost as compared to the cost of labor required to manually fold and form a similarly functioning releasably lockable lid of the prior art which has been used in this field for many years.

Figure 3:
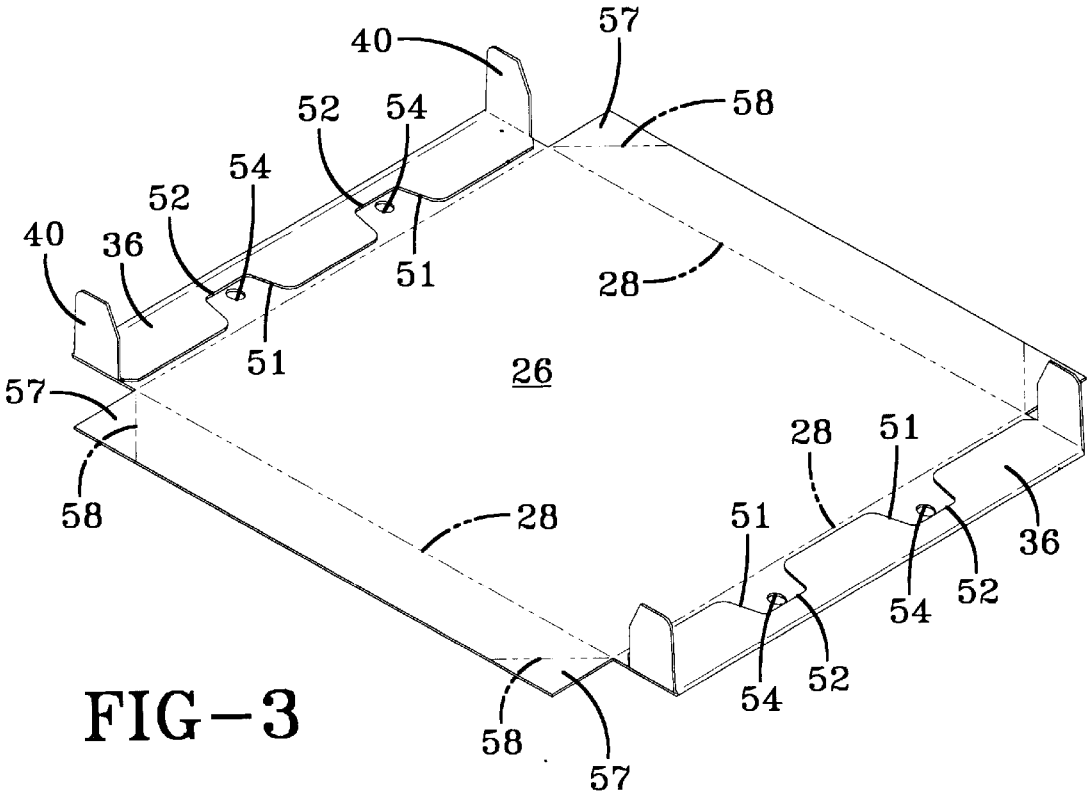
FIG. 3 is a perspective view of the planar blank shown in FIG. 2 in a partially erected condition.

Now referring to FIGS. 2 and 3, the first step in erecting lid 20 consists of placing a dab-like portion of adhesive at 44 indicated by "x" on each side portion 36 and then causing each side portion 36 to fold along fold line 33 in overlying relationship to the remainder of side wall 30 to form a double ply configuration. The adhesive at 44 serves to fix the overlying portions of sidewall 30 in this double ply configuration as seen in FIG. 3.

Figure 4:
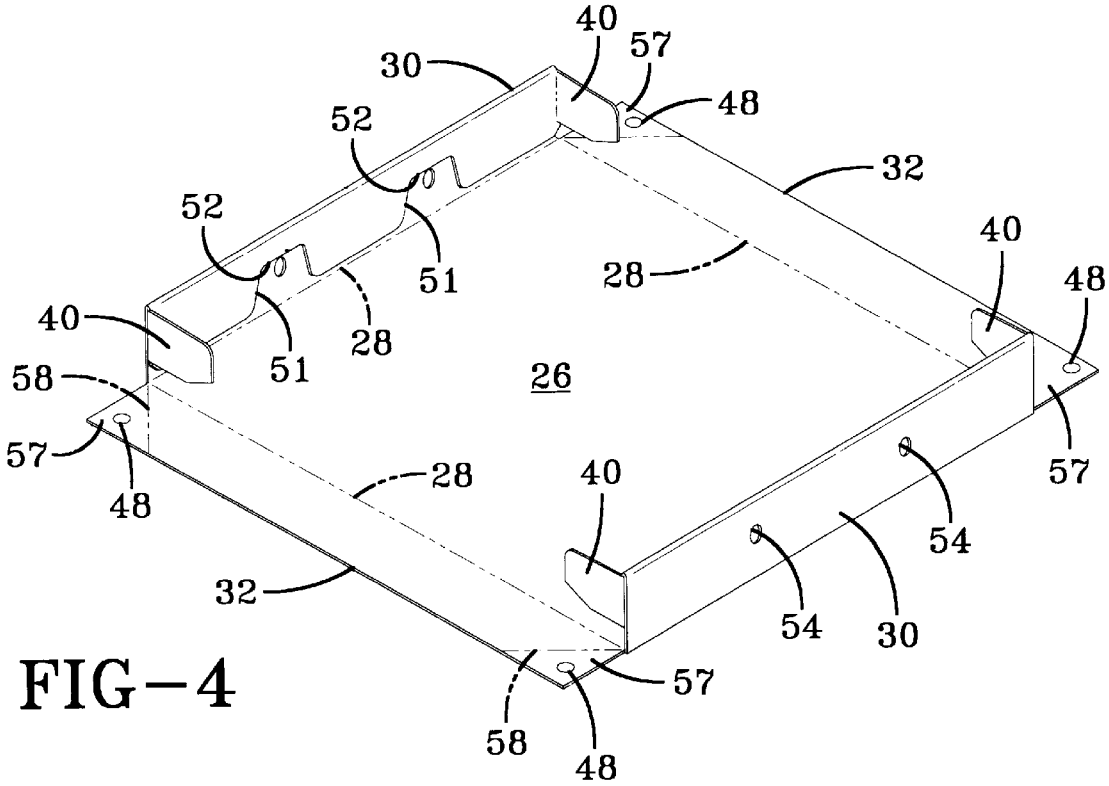
FIG. 4 is a perspective view of the planar blank shown in FIG. 3 in a partially erected condition illustrating a further folding step.

End flaps 40 may also be folded inwardly at generally a right angle to side portion 36. As the blank proceeds in the folding machine, another dab-like portion of adhesive applied to the end portions of side walls 32 at the positions 48 indicated by "o" and side walls 30, in the double ply configuration shown in FIG. 3, are caused to be folded upwardly about opposing fold lines 28, as shown in FIG. 4, to dispose flaps 40 generally parallel to opposing fold lines 28 defining the inner extent of side walls 32.

Figure 5:
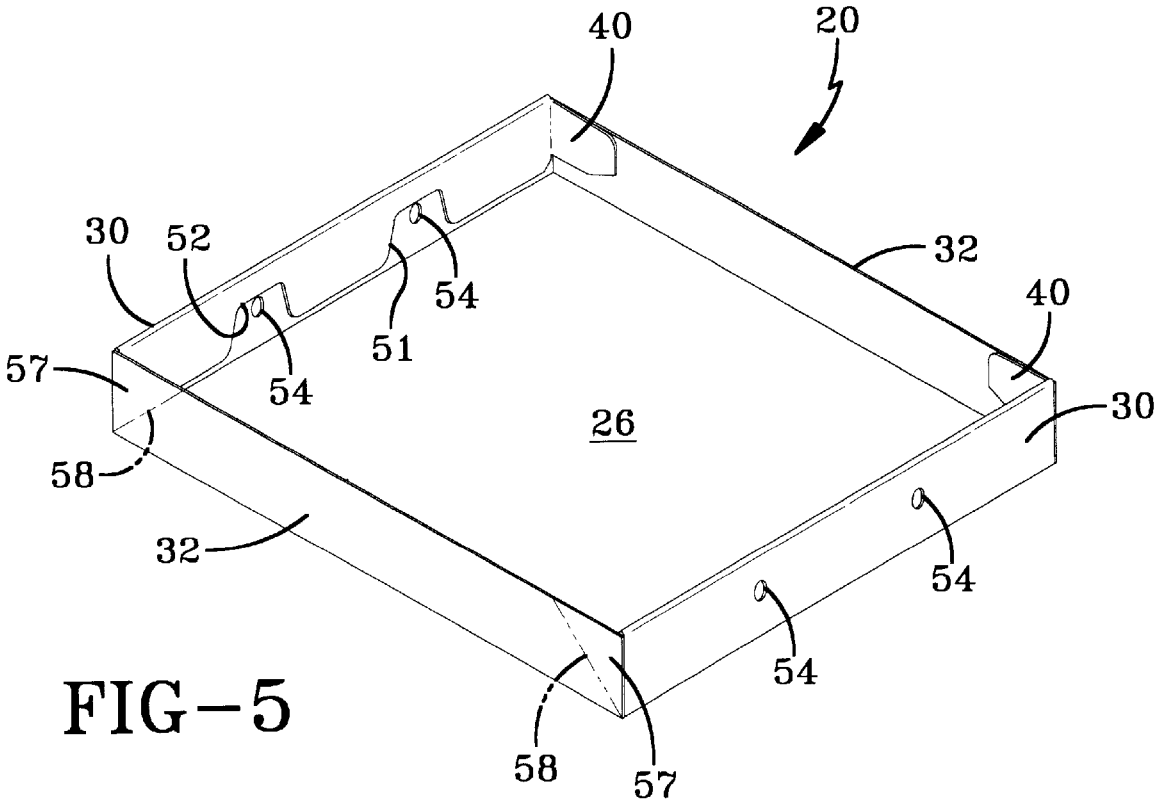
FIG. 5 is a perspective view of the planar blank shown in FIG. 4 in a fully erected condition illustrating all the side walls folded about the respective fold lines formed in the blank to erect the lid.

As seen in FIG. 5, side walls 32 are then folded about the opposing fold lines 28 to form generally a right angle to top wall 26 such that each end portion of sidewalls 32 and the adhesive applied at the locations 48 are pressed against flaps 40 and are adhered thereto to complete the erected form of lid 20.

Upon completion of the erection of lid 20, it can be seen in the Figures that each cut-out portion 42 now forms a recess 51 on the inwardly facing side of the double ply configuration of side walls 30 and have an open end facing top wall 26 and a closed end forming a lip 52. Preferably, a pair of holes, such as 54, are provided in side walls 30 which are aligned with the recess 51 formed in the double ply configuration of walls 30 described herein to aid in releasing the locked relationship as described below.

Figure 6:
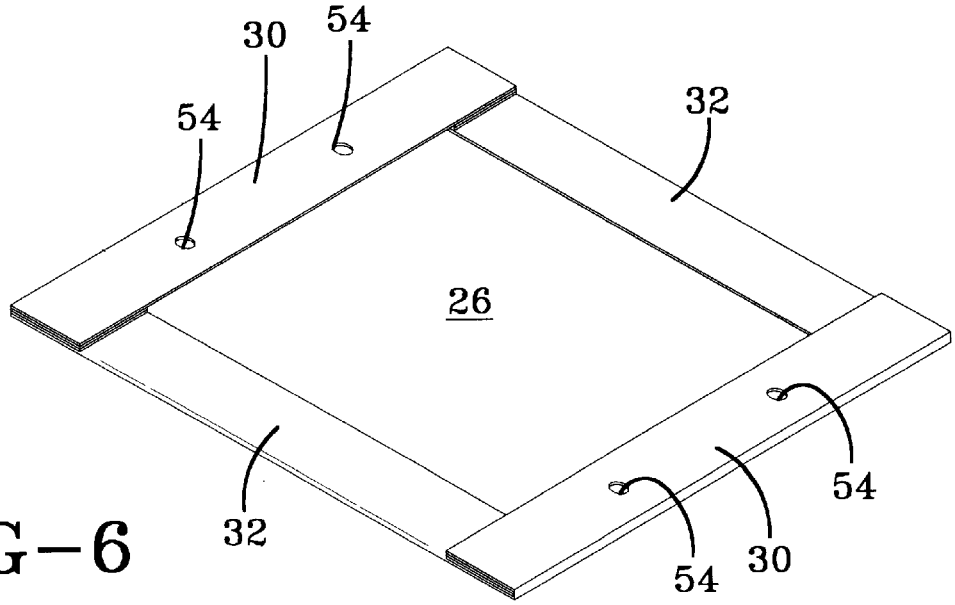
FIG. 6 is a perspective view of a preferred embodiment of the lid shown in the preceding Figures illustrating the folded flat condition of the erected lid closure convenient for storage or shipping of the lid closure.

Now referring to FIG. 6, it is preferred to include a diagonally disposed fold line 58 directed toward the corner of side walls 30 and 32 such that a completely erected lid may be folded into a generally flat configuration, such as seen in FIG. 6, for storage and shipping convenience.

Figure 7:
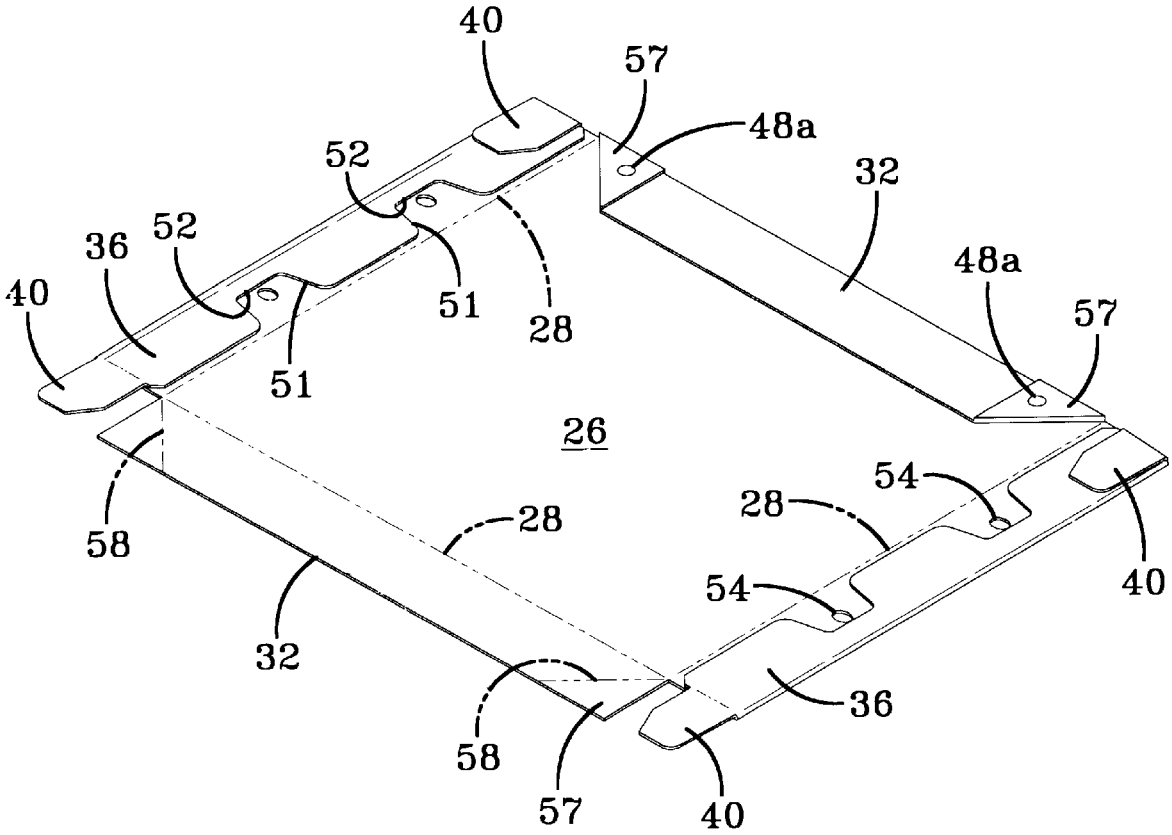
FIG. 7 is a perspective view of a planar blank such as shown in FIG. 2 folded in an alternative manner compared to the folding steps shown in the preceding Figures.
Figure 8:
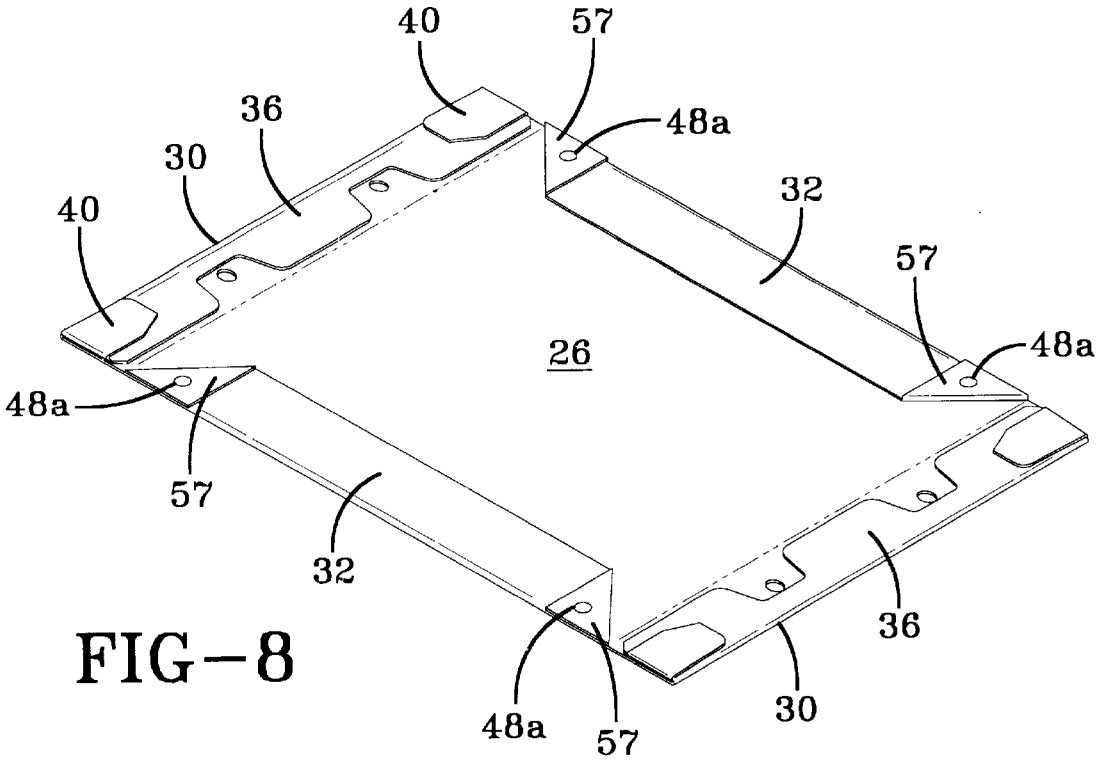
FIG.8 is a perspective view of the planar blank shown in FIG. 7 illustrating a further folding sequence as compared to that shown in FIG. 7.
Figure 9:
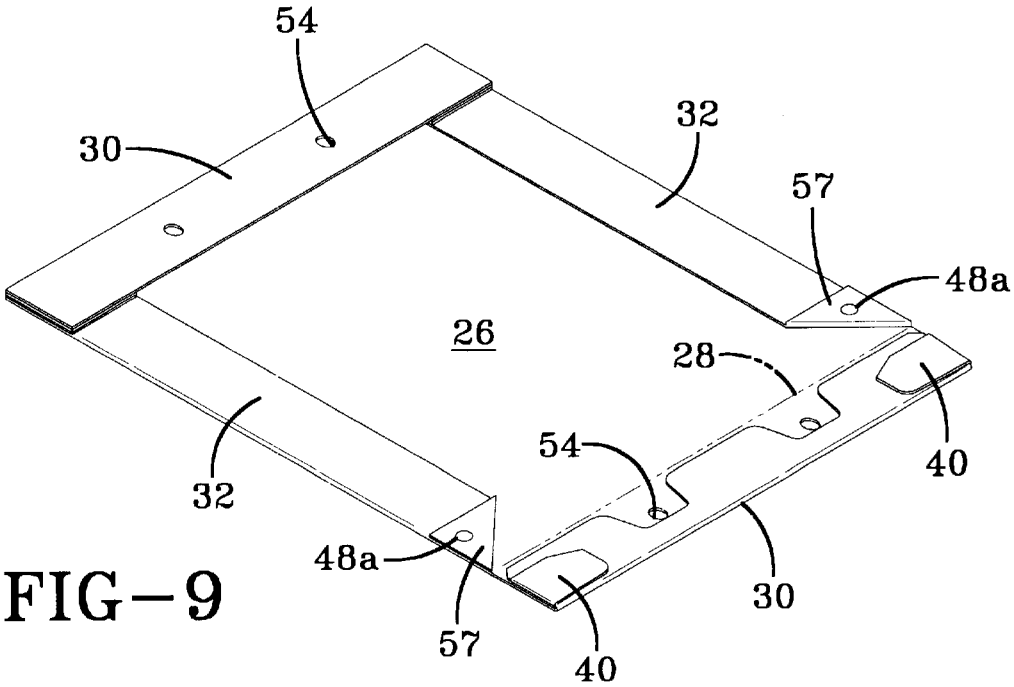
FIG. 9 is a perspective view similar to that shown in FIG. 8 illustrating a further folding sequence as compared to that shown in FIG. 8.

An alternative and more preferred folding sequence is illustrated in FIGS. 7–9 wherein end flaps 57 defined by diagonal score lines 58 are folded inwardly over the adjacent portion of a respective side wall 32. A dab of adhesive may be applied to the exposed surface of flap 57. Then side wall 30 is caused to be folded over itself along fold line 33 to form the double ply configuration earlier described herein.

Then flaps 40 are folded inwardly to overlie the adjacent upper portion 36 of side wall 30 which is in the double ply configuration described above as shown in FIG. 7. Then side walls 32 may be folded about fold lines 28 until they are pressed flat against top wall 26 with the prefolded flaps 57 carrying the dab of adhesive facing upwardly. Next flaps 40 are folded about fold lines 38 to an overlying position relative to the upper portion 36 of side wall 30 as seen in FIG. 8. Then each side wall 30, in the double ply configuration is folded about fold line 28 so that flaps 40 are pressed against flaps 57 and glued thereto to connect the side walls 30 and 32 together as illustrated on the left side of the lid in FIG. 9.

The described alternative folding sequence provides assembled lid 20 in the folded configuration described earlier herein and shown in FIG. 6 for convenience in storage and for shipping purposes. Upon reaching the intended user destination, each lid 20 may be easily erected into the assembled condition shown in FIG. 5 by simply pulling the side walls 30 and 32 into a vertical disposition preferably via raising each corner to an upright condition.

Referring to FIG. 1, upon placing the erected lid 20 over the top opening of box 22, flaps 24 are forced downwardly and are aligned to become inserted within the recesses 51 such that the free ends of flaps 24 interferringly engage a respective one of lips 52 of a respective one of recesses 51.

To easily remove lid 20, one merely uses, either a finger or an implement such as pen or pencil, for example, to push flaps 24 inwardly away from lip 52 as lid 20 is lifted upwardly to release the lid 20 from its locked configuration.

The arrangement of the fold lines and the configuration of the side walls 30 and 32 permit the blank to be run through standard paperboard folding apparatus wherein adhesive is also applied to the locations 44 and 48 at the desired stage so that a completely formed, adhesively held, lid construction may be made using automated equipment as opposed to requiring manual steps to complete the formation of the prior art releasably locking lid configuration.

What is claimed is:

1. A releasable locking lid formed from a planar blank of material for a box type container comprising, in combination:

a) a top wall defined between two pairs of opposing first fold lines, each pair of first fold lines intersecting an end of said opposing pair of first fold lines;

b) a first and second pair of opposing side walls extendable from said top wall along said first fold lines to form a four sided enclosure surrounding said top wall;

c) each of said first pair of opposing side walls having a double ply configuration and provided with a second fold line disposed parallel to one of said first fold lines and spaced from an outer free edge to define a pair of side wall portions, said side wall portions being foldable along said second fold line in overlying relationship to one another and adhesively bonded to one another to form said double ply configuration; said side wall portion including said outer free edge being provided with a pair of opposing end flaps, each of said end flaps defined by a fold line disposed generally perpendicular to and intersecting one of said second fold lines;

d) each of said outer free edges of said first pair of side walls including at least one cut-out portion having an open end facing said top wall when said side wall portions are folded over one another to form at least one recess in an inwardly facing portion of said double ply configuration;

e) each of said second pair of opposing side walls being adhesively fixed to one of said end flaps of a respective one of said first pair of opposing side walls when said end flaps are folded in overlapping relationship to an adjacent end portion of said second pair of opposing side walls to maintain said first and second pair of opposing side walls in said four-sided enclosure configuration surrounding said top wall.

2. The lid defined in claim 1 wherein said side wall portions of said first opposing pair of side walls forming the outwardly facing portion of said double ply configuration including an opening aligned with said at least one recess.

3. The lid defined in claim 1 wherein said second opposing pair of side walls include diagonal fold lines intersecting each corner formed by the intersection of said two pairs of first fold lines.

* * * * *